US006158408A

United States Patent [19]

Hauder

[11] Patent Number: 6,158,408

[45] Date of Patent: Dec. 12, 2000

[54] CYLINDER HEAD AND CASTING CORE FOR PRODUCING OIL CHANNELS

[75] Inventor: Walter Hauder, Osterreich, Austria

[73] Assignee: VaW mandl & berger GmbH, Linz, Austria

[21] Appl. No.: 09/089,588

[22] Filed: Jun. 3, 1998

[30] Foreign Application Priority Data

Jun. 4, 1997 [DE] Germany ..... 197 23 342

[51] Int. Cl.[7] ..... F02F 1/00

[52] U.S. Cl. ..... 123/193.5

[58] Field of Search ..... 123/193.5, 193.3, 123/90.27, 195 R

[56] References Cited

U.S. PATENT DOCUMENTS

| | | | |
|---|---|---|---|
| 4,823,747 | 4/1989 | Wagner et al. | 123/193.5 |
| 5,080,057 | 1/1992 | Batzill et al. | 123/90.27 |
| 5,121,718 | 6/1992 | Saito | 123/90.27 |
| 5,207,197 | 5/1993 | Klingmann et al. | 123/90.27 |

FOREIGN PATENT DOCUMENTS

| | | |
|---|---|---|
| 0 499 601 A1 | 8/1992 | European Pat. Off. . |
| 3710630 A1 | 7/1988 | Germany . |
| 4117162 A1 | 11/1992 | Germany . |
| 19542495 C1 | 1/1997 | Germany . |
| 19547490 C1 | 1/1997 | Germany . |
| 4-91351 | 3/1992 | Japan . |

*Primary Examiner*—Marguerite McMahon
*Attorney, Agent, or Firm*—Harness, Dickey & Pierce, P.L.C.

[57] ABSTRACT

A cylinder head with a plurality of cylinder portions for a multi-cylinder internal combustion engine has, in each cylinder portion, a central bore to receive an injection nozzle or spark plug. Also, gas changing channels extend from the deck face facing the cylinder block and emerge from side faces. The valve guide bores are directed towards the ends of the gas changing channels in the deck face. Recesses, for hydraulic cup tappets, are arranged co-axially relative to the valve guide bores. Bearing cradles are present for at least one camshaft. Further, the cylinder head, along the cylinder portions, has an extending cast longitudinal oil channel which supplies oil to the hydraulic cup tappets and, optionally, to the camshaft bearing regions. The longitudinal oil channel, with annular branching channels, enclose each of the bores for the injection nozzle or spark plug.

10 Claims, 5 Drawing Sheets

CYLINDER HEAD AND CASTING CORE FOR PRODUCING OIL CHANNELS

BACKGROUND OF THE INVENTION

The invention relates to a cylinder head having a plurality of cylinder portions for a multi-cylinder internal combustion engine. Each cylinder portion includes a central bore to receive an injection nozzle or a spark plug. Gas changing channels extend from the deck face, facing the cylinder block, and emerge from side faces. Valve guide bores are directed towards the ends of the gas changing channels in the deck face. Recesses, for hydraulic cup tappets, are arranged co-axially relative to the valve guide bores. Bearing cradles are present to receive at least one camshaft. Also, the cylinder head, along the cylinder portions, has an extending cast longitudinal oil channel. The oil channel supplies pressurized oil to the hydraulic cup tappets and, optionally, camshaft bearing regions. Furthermore, the invention relates to a casting core for a cast longitudinal oil channel in such a cylinder head for a multi-cylinder internal combustion engine.

DE 195 42 495 C1 discloses cylinder heads with pre-cast or finish-cast longitudinal oil channels and cup tappet recesses. An approximately centrally extending central longitudinal oil channel requires the spark plug bore of each cylinder to be offset and inclined.

EP 0 499 601 A1 describes a cylinder head with two cast parallel longitudinal oil channels. The channels are guided along the outer walls of the cylinder head. Long connecting bores which extend from the longitudinal oil channels to the recesses are required to lubricate the hydraulic valve tappets. The connections starting from the connecting bores between the camshaft bearing regions and the longitudinal oil channels are extremely complicated.

DE 41 17 162 A1 illustrates a cylinder head with two cast longitudinal oil channels which extend along both side faces of the cylinder head. The longitudinal oil channels are connected by cast transverse channels between the respective cylinders. This design requires an extremely complicated and filigree casting core.

SUMMARY OF THE INVENTION

It is an object of the present invention to provide a cylinder head with oil channels to supply pressurized oil to the hydraulic cup tappets and optionally to the camshaft bearings. The channels are uncomplicated and feature advantageous flow conditions. It is also an object of the invention to provide a casting core to produce the oil channels of the cylinder head. The casting core has a compact and simple design.

The objective is achieved by a cylinder head with a longitudinal oil channel which encloses the injection nozzle or spark plug bore in the region of each cylinder with annular branching channels. To produce such a cylinder head, a casting core is proposed which includes a longitudinal oil channel core with an annular branching core in the region of each cylinder.

An inventive cylinder head enables the injection nozzle or spark plug of each cylinder to be arranged as centrally as possible. The longitudinal oil channel is of a simple design. The connections between the longitudinal oil channel and the hydraulic cup tappets and the camshaft bearing regions are of compact design and have advantageous flow conditions. The inventive cylinder head is excellently suited for four-valve engines and for two-camshaft engines. In the case of cylinder heads where additional bores are provided for an injection nozzle or a spark plug per cylinder, gasoline direct injection engines, or for a glow plug per cylinder, diesel engines, it is proposed that the cast longitudinal oil channel also encloses each of the further bores with annular branching channels. Alternatively, it is possible for the cast longitudinal oil channel to surround each of the further bores with buckled or bent portions.

The inventive casting cores may be designed so that the cores for the connections of the cup tappet recesses and the cores for the connections leading to the camshaft bearing regions each start from annular branching cores. The connecting cores are in the form of horizontal lobes leading to the tappet recess cores and in the form of radial fins leading to the bearing regions. In a preferred embodiment, radial supporting cores are additionally provided for the lobe-shaped connecting cores. The radial supporting cores, for reinforcing purposes, start perpendicularly from the lobe-shaped connecting cores and are supported directly on an annular branching core. Core bearings are preferably provided at tappet recess cores in order to provide connections with a valve drive pan core and with an oil return chamber core without producing function-less holes which have to be closed.

From the following detailed description, taken in conjunction with the drawings and subjoined claims, other objects and advantages of the present invention will become apparent to those skilled in the art.

BRIEF DESCRIPTION OF THE DRAWINGS

Further details of the invention become obvious from the embodiment of an inventive casting core illustrated in the drawings and from the cylinder head, parts of which are shown.

DETAILED DESCRIPTION OF THE PREFERRED EMBODIMENT

Figure 1:
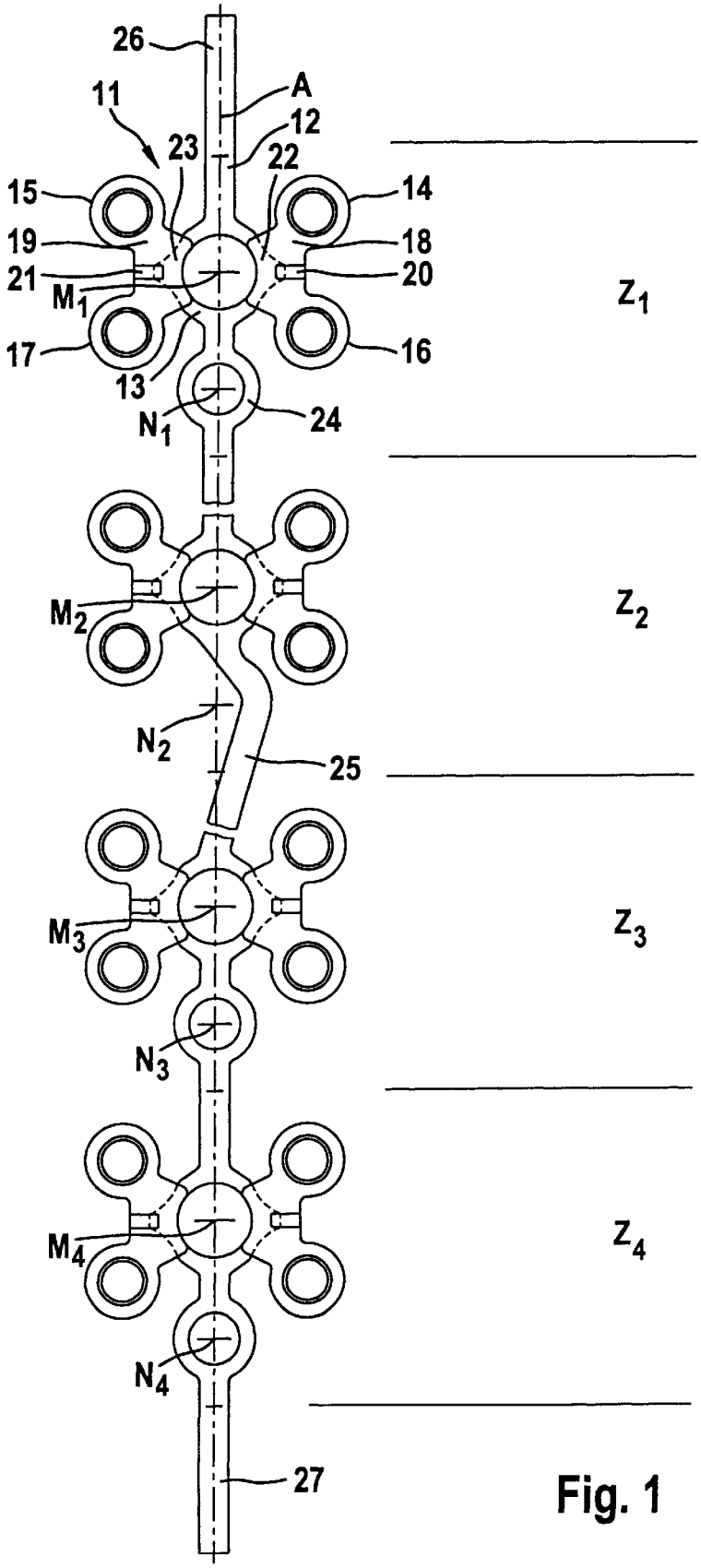
FIG. 1 is a plan view of an inventive casting core for the oil channel of an inventive cylinder head.

FIG. 1 shows a casting core 11 for an oil channel of a four-cylinder engine. The cylinder portions associated with the individual cylinders, from the top to the bottom, are given the reference symbols $Z_1$, $Z_2$, $Z_3$, $Z_4$. In the region of cylinders 2 and 3 it is indicated by interrupted lines that a first embodiment comprising the cylinder portions $Z_1$, $Z_3$, $Z_4$, in this case, is replaced by a second embodiment which, substantially, comprises the cylinder portion $Z_2$. The differences between the two embodiments will be described later.

The center of the individual cylinder portions $Z_1$–$Z_4$ is indicated by a reference line cross which indicates the centers $M_1$, $M_2$, $M_3$, $M_4$ of central bores in the individual cylinder portions $Z_1$–$Z_4$ of an inventive cylinder head. The centers $M_1$–$M_4$ are connected by an axis A. At a predetermined distance from the centers $M_1$–$M_4$, in the individual cylinder portions, a further reference line cross is present which indicates the centers $N_1$, $N_2$, $N_3$, $N_4$ of additional eccentric bores in the individual cylinder portions $Z_1$–$Z_4$ of the inventive cylinder head.

A longitudinal oil channel core 12 extends in the direction of axis A. The longitudinal oil channel core 12, in the region of the central bores, has annular branching cores 13. The annular branching cores 13 extend concentrically relative to the centers $M_1$–$M_4$. As can be seen later, the longitudinal oil channel core 12 has an approximately rectangular cross-section. The annular branching cores 13 have approximately the same profile height as the longitudinal oil channel core 12.

In each cylinder portion $Z_1$–$Z_4$, on each side, two cup tappet cores 14, 15, 16, 17 are provided. The tappet cores 14, 15, 16, 17 extend symmetrically relative to the axis A. The tappet cores 14, 16, 15, 17 on one side of axis A are associated with two inlet valves of a cylinder. The other tappet cores 15, 17, 14, 16 on the other side of axis A are associated with two outlet valves of the cylinder. The cup tappet cores 14–17 are connected by lobe-shaped tappet connecting cores 18, 19 to an annular branching core 13. The connect cores 18, 19 are placed onto the branching core 13 on a higher plane.

Approximately in the center on the tappet connecting cores 18, 19, two bearing connecting cores 20, 21 are provided for the camshaft bearings. The bearing connecting cores 20, 21 are placed in a fin-like way onto the tappet connecting cores 18, 19. Dashed lines show that the annular branching cores 13, underneath the above-mentioned bearing connecting cores 20, 21, are provided with supporting core lobes 22, 23. The supporting core lobes 22, 23 extend perpendicularly relative to the axis A and reinforce the tappet connecting cores 18, 19. All the core portions change into one another at corresponding abutment faces. The core portions can be provided in one piece or they may be of a composite nature.

In the first embodiment as illustrated with reference to cylinders 1, 3 and 4, at some distance from the annular branching core 13, a further annular branching core 24 is provided. The function of the further annular branching core 24 is to bypass a bore for a spark plug or a glow plug of the respective cylinder.

In a second embodiment as illustrated with reference to cylinder 2, the further annular branching core is substituted by a bypass channel core portion 25 of the central longitudinal oil channel core 12. The bypass channel core portion 25 deviates from the axis A and serves to bypass a bore for a spark plug or a glow plug of the cylinder on one side only.

Core lengthening portions 26, 27 are provided at the outer ends of the longitudinal oil channel core 12. The purpose of the core lengthening portions 26, 27 is to provide oil channel portions connected to a pressurized oil supply source from the cylinder block via additional bores.

Figure 2:
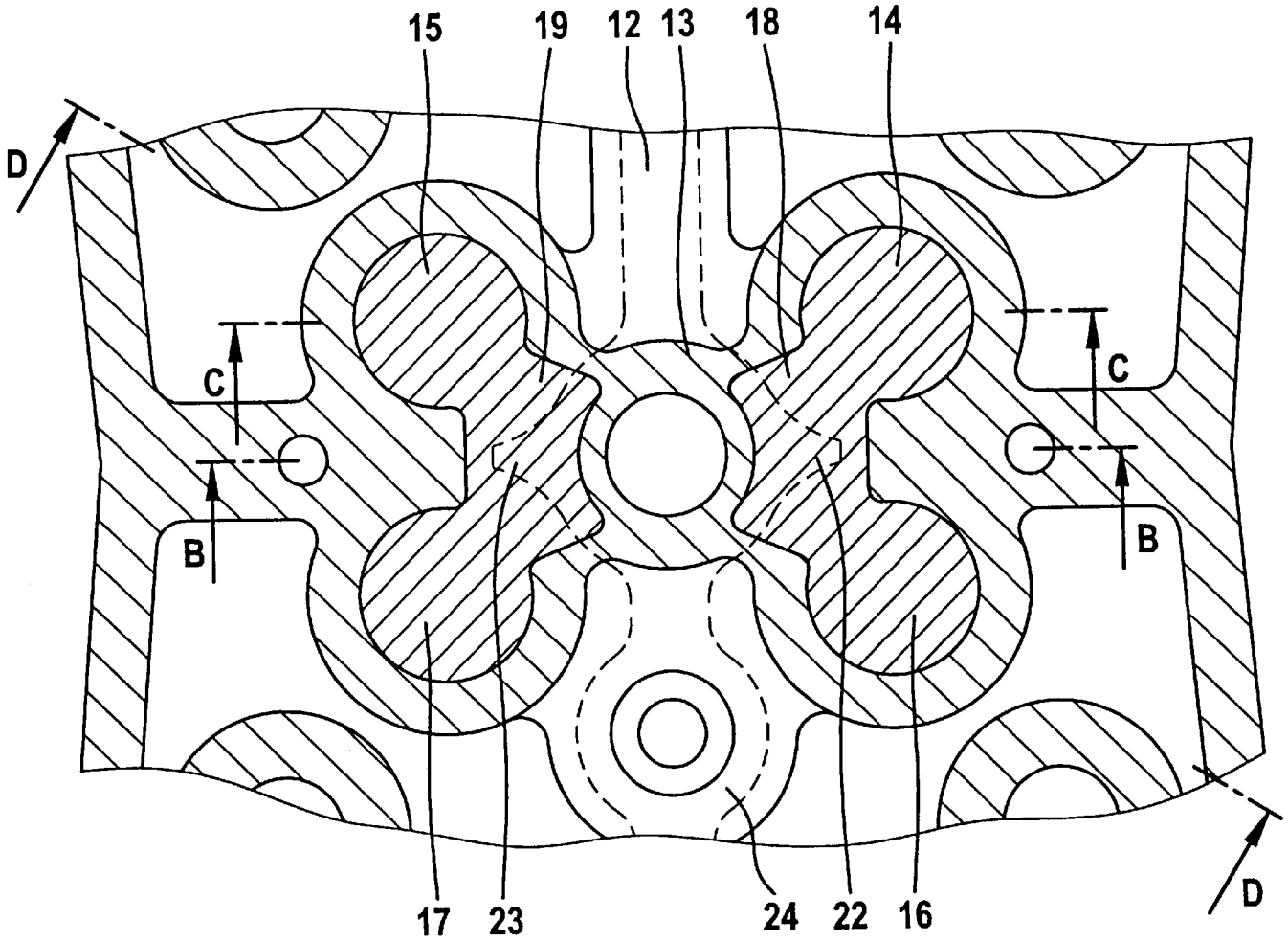
FIG. 2 is a horizontal section view through a longitudinal portion of an inventive cylinder head with an inventive casting core according to FIG. 1 along sectional line A—A of FIG. 4.
Figure 4:
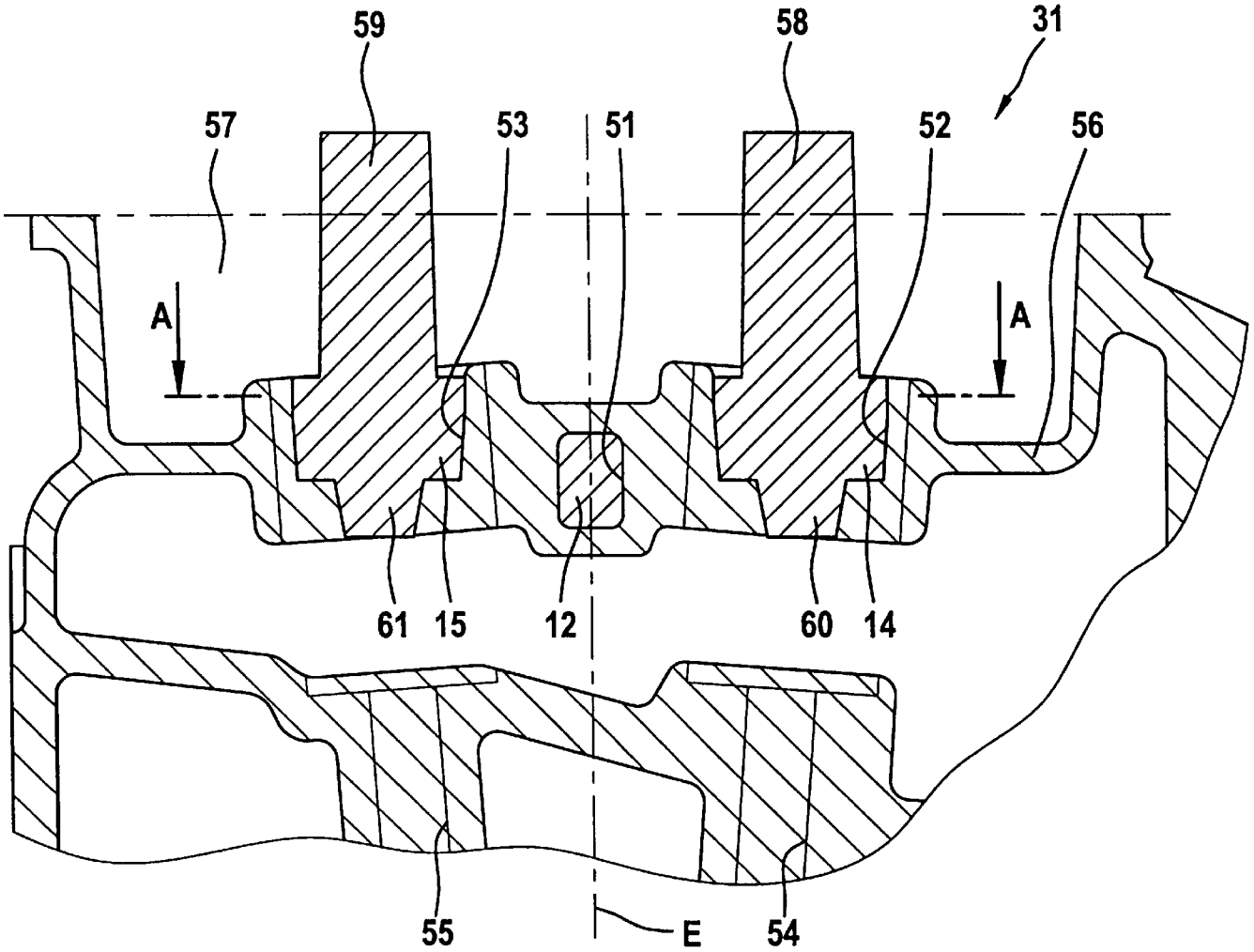
FIG. 4 is a vertical section view along sectional line C—C of FIG. 2.

FIG. 2 shows a portion of an inventive cylinder head 31 with a longitudinal oil channel core 12, an annular branching core 13 and a further annular branching core 24 in a cross-section through the sectional plane A—A of FIG. 4. The longitudinal oil channel core 12 and the annular branching cores 13, 24 are covered and indicated by dashed lines. In the horizontal section, it is possible to identify the tappet connecting cores 18, 19 located on a higher plane. The tappet recess cores 14, 15, 16, 17 are attached in pairs to the tappet connecting cores. The supporting core lobes 22, 23, which serve to reinforce the core structure, are also covered and shown in dashed lines.

Figure 3:
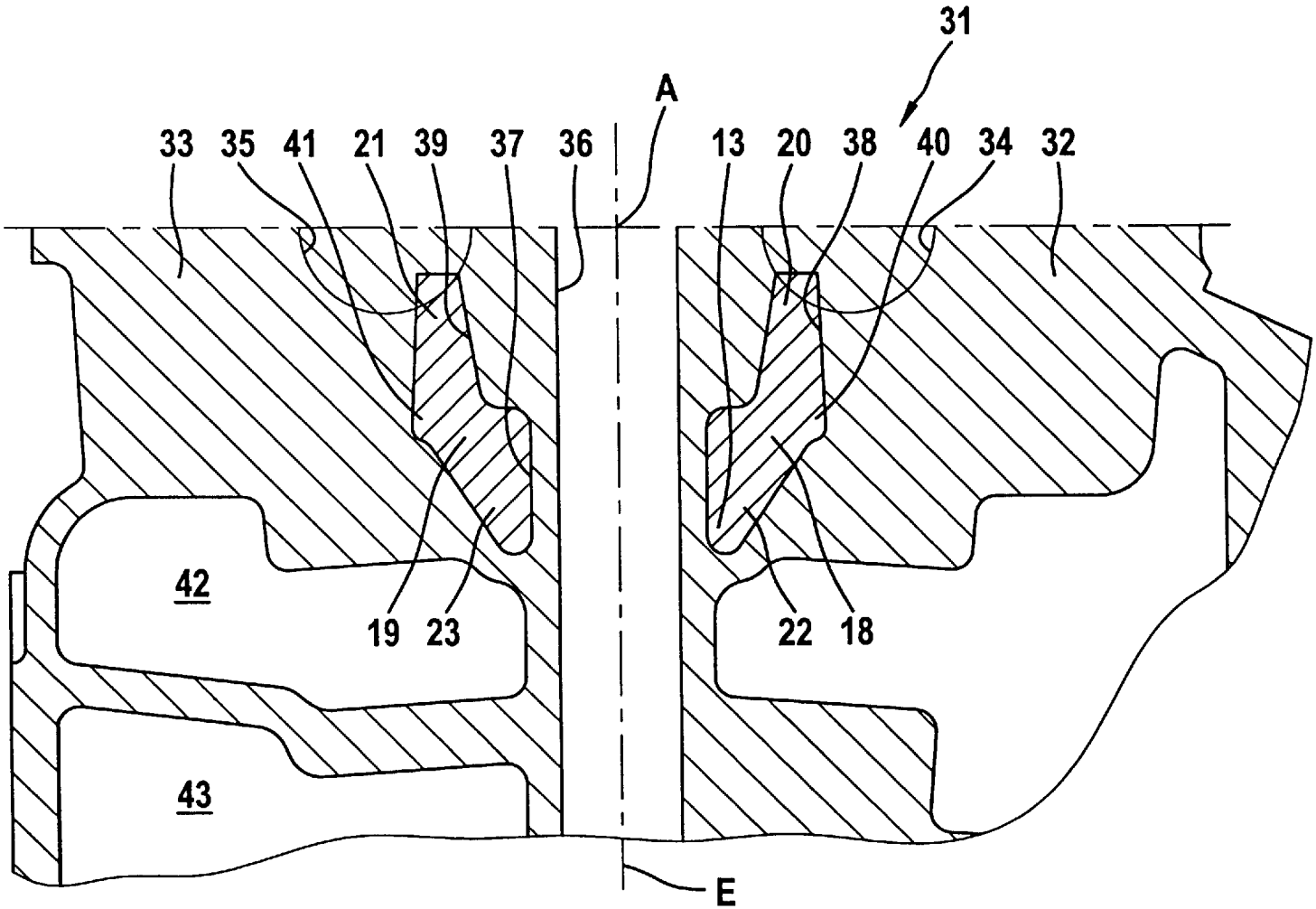
FIG. 3 is a vertical section view through sectional line B—B of FIG. 2.

FIG. 3 shows a cross-section view through the sectional plane B—B of FIG. 2 through part of an inventive cylinder head wherein the lower part pointing to the cylinder crank housing is broken off. A perpendicular central plane E is defined by the position of the axis A. A central bore 36 serves to receive an injection nozzle or a spark plug. Furthermore, there is shown a section through two camshaft bearing cradles 32, 33 which each form lower bearing bore halves 34, 35. An annular branching channel 37 is connected to upwardly projecting bearing connecting channels 38, 39 by means of tappet connecting channels 40, 41 which are positioned transversely therebetween and which are widened by channels which are produced by the supporting cores 22, 23 and which are not described in greater detail. In this sectional view, the oil channel core has not yet been removed and is shown in section in the region of an annular branching core 13. Two adjoining bearing connecting cores 20, 21 project upwardly in a fin-like way and cut into the lower bearing bore halves 34, 35. Supporting cores 22, 23 are positioned between the annular branching core 13 and the tappet connecting cores 18, 19. Below the latter it is possible to identify a large-volume oil return channel 42 and a cooling water chamber 43.

FIG. 4 shows an inventive cylinder 31 in a vertical section through the sectional plane C—C of FIG. 2. The lower part pointing to the cylinder crank housing is broken off. A longitudinal oil channel 51 is disposed centrally between two tappet recesses 52, 53. An intermediate floor forms a valve drive pan 57 to which the oil return channel 42 is connected by means of the tappet recesses 52, 53 for lubricating the hydraulic cup tappets. From the oil return channel 42, valve guide bores 54, 55, for the valve shafts, extend downwards approximately symmetrically relative to the central plane E. The longitudinal oil channel 51 is occupied by the longitudinal oil channel core 12 which has not yet been removed. The tappet recesses 52, 53 are occupied by tappet recess cores 14, 15 which, again, have not yet been removed. Core bearings 58, 59 are arranged at the upper ends of the tappet recess cores 14, 15. The core bearings 58, 59 are connected to a valve drive pan core. At the lower ends of the tappet recess cores 14, 15, core bearings 60, 61 are provided to be connected to an oil return chamber core.

Figure 5:
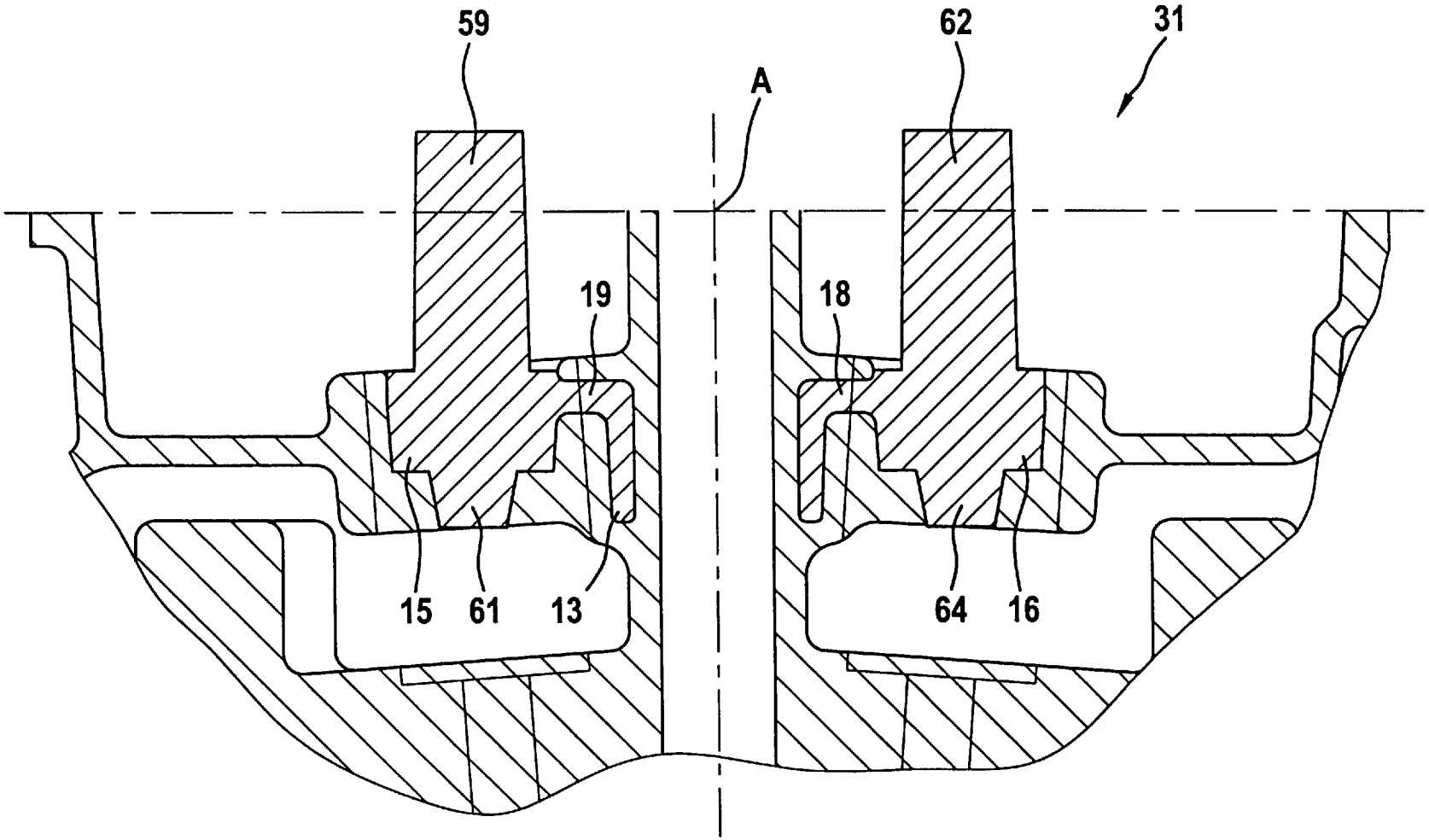
FIG. 5 is a vertical section view along sectional line D—D of FIG. 2.

FIG. 5 shows an inventive cylinder head 31 in a vertical section according to sectional line D—D of FIG. 2. As far as details are concerned, it is possible to see the annular branching core 13, the tappet connecting cores 18, 19 and two tappet recess cores 15, 16. Furthermore, in this illustration, the tappet recess cores 15, 16 are provided with core bearings 59, 61 and 62, 64 respectively.

While the above detailed description describes the preferred embodiment of the present invention, the invention is susceptible to modification, variation and alteration without deviating from the scope and fair meaning of the subjoined claims.

What is claimed is:

1. A cast cylinder head having a plurality of cylinder portions for a multi-cylinder internal combustion engine with each cylinder portion comprising:

a central bore for receiving an injection nozzle or a spark plug;

gas changing channels extending from a deck face of said cast cylinder head and emerging from side faces of said cast cylinder head;

valve guide bores directed towards the ends of the gas changing channels in the deck face of said cast cylinder head;

recesses for hydraulic cup tappets, said recesses arranged co-axially relative to the valve guide bores;

bearing cradles for receiving at least one cam shaft;

a longitudinal oil channel formed in said cast cylinder head during casting, said longitudinal oil channels extending along each of the cylinder portions, said longitudinal oil channel serving to supply pressurized oil to at least one of hydraulic cup tappets and camshaft bearing regions; and said longitudinal oil channel enclosing each of said central bores for the injection nozzles or spark plugs with annular branching channels.

2. A cast cylinder head according to claim 1, wherein said longitudinal oil channel with said annular branching channels is positioned symmetrically on a longitudinal axis extending through said central bores for injection nozzles or spark plugs.

3. A cast cylinder head according to claim 1, wherein each cylinder region comprises a further bore for an injection nozzle or a spark plug or a glow plug, and said cast longitudinal oil channel also encloses each of the further bores with annular branching channels.

4. A cast cylinder head according to claim 1, wherein each cylinder region comprises a further bore for a spark plug or a glow plug, said cast longitudinal oil channel including buckled portions or bent portions which circumvent each of the further bores.

5. A cast cylinder head according to claim 1, wherein from the cast longitudinal oil channel, cast tappet connecting channels emerging in the region of the annular branching channels to extend to cast tappet recesses for the hydraulic cup tappets.

6. A cast cylinder head according to claim 1, wherein from the cast longitudinal oil channel, cast tappet connecting channels emerging in the region of the annular branching channels to reach lower bearing bore halves of the bearing cradles.

7. A cast cylinder head according to claim 5, wherein around each central bore four tappet recesses are disposed for hydraulic cup tappets, said four tappet recesses are connected to an annular branching channel by planar tappet connecting channels.

8. A cast cylinder head according to claim 6, wherein two opposed bearing connecting channels extend from one annular branching channel to two opposed lower bearing bore halves of the bearing cradles for two camshafts.

9. A cast cylinder head according to claim 8, wherein the bearing connecting channels leading to the lower bearing bore halves of the bearing cradles emerge externally radially in a fin-shaped way from the annular branching channels.

10. A cast cylinder head according to claim 9, wherein the cast bearing connecting channels leading to the lower bearing bore halves emerge directly from the cast tappet connecting channels leading to the cast tappet recesses.

* * * * *